United States Patent [19]

Finley et al.

[11] 4,456,093

[45] Jun. 26, 1984

[54] CONTROL SYSTEM FOR AERIAL WORK PLATFORM MACHINE AND METHOD OF CONTROLLING AN AERIAL WORK PLATFORM MACHINE

[75] Inventors: David R. Finley, Irvine; Laurence A. Beck, San Bernardino, both of Calif.

[73] Assignee: Interstate Electronics Corp., Anaheim, Calif.

[21] Appl. No.: 274,476

[22] Filed: Jun. 16, 1981

[51] Int. Cl.[3] ..... B66F 11/04

[52] U.S. Cl. ..... 182/2; 182/18; 182/19; 212/149; 212/155; 364/463

[58] Field of Search ..... 182/18, 50, 2, 19; 212/155, 149; 364/463

[56] References Cited

U.S. PATENT DOCUMENTS

| | | | |
|---|---|---|---|
| 3,740,534 | 6/1973 | Keger et al. | 364/463 X |
| 4,178,591 | 12/1979 | Geppert | 212/155 X |
| 4,359,137 | 11/1982 | Merz et al. | 182/18 X |

OTHER PUBLICATIONS

"Markload Digital Display" by Markload Systems, Inc., (5 Leaflets).

"Step Up To the Ultimate In Portable Weighing In Motion", (2 brochures, 8 leaflets.

"Mobile Scaffolding" by Mobile Scaffolding of La Miraca, CA, (brochure with leaflets).

"Compulift Crane Warning Systems" by Litton Systems, Inc., (brochure).

"Weighload Rated Load Indicator" by Weighload, Inc., (brochure).

*Primary Examiner*—Felix D. Gruber

*Assistant Examiner*—Ronni S. Malamud

*Attorney, Agent, or Firm*—Knobbe, Martens, Olson & Bear

[57] ABSTRACT

An electronic control system allows control over the safe operation of an aerial work platform machine. The control system uses a firmware programmed digital processor to execute a sequence of steps to monitor and control the safe operation of the work platform machine so that tipping and damage are prevented. The control system has sensors to measure the condition of the work platform machine and has outputs allowing control over the work platform machine.

23 Claims, 12 Drawing Figures

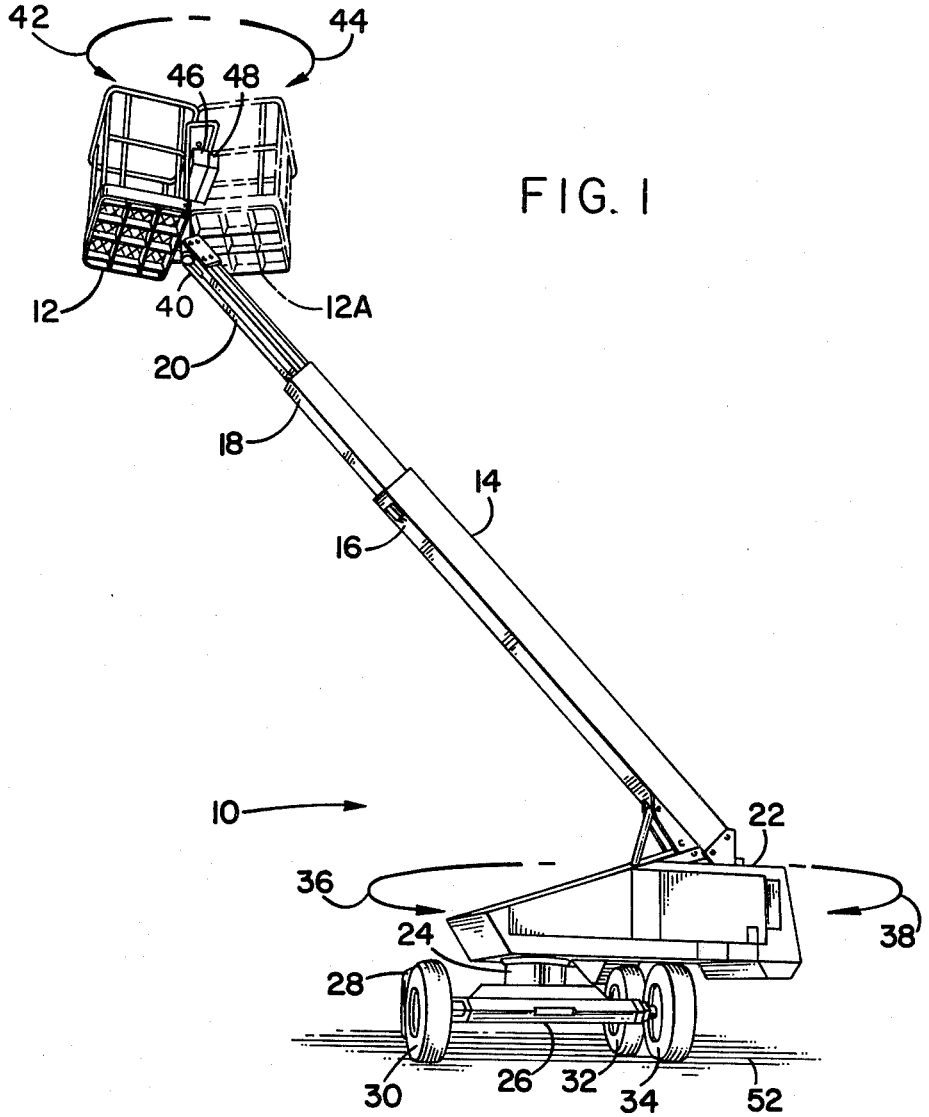
FIG. 1
FIG. 2
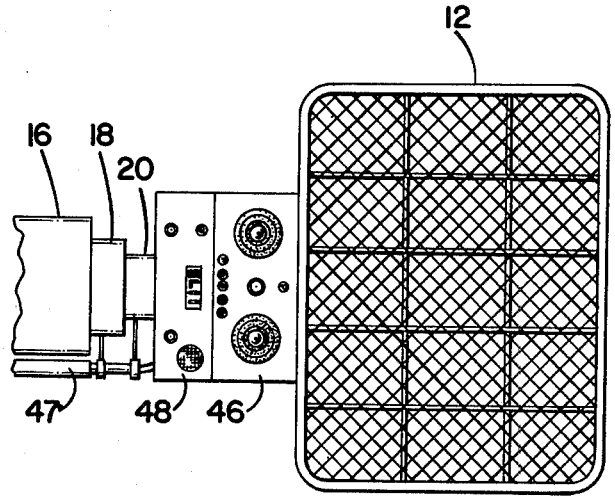

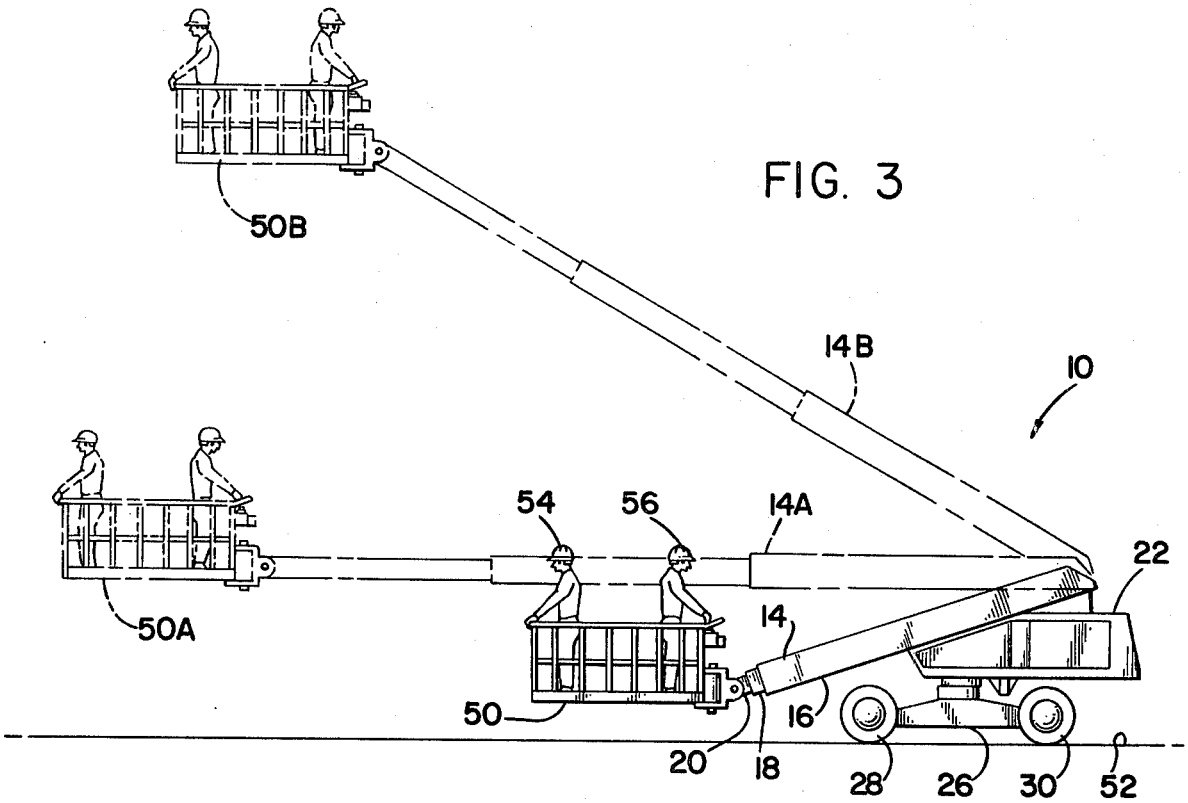
FIG. 3
FIG. 6
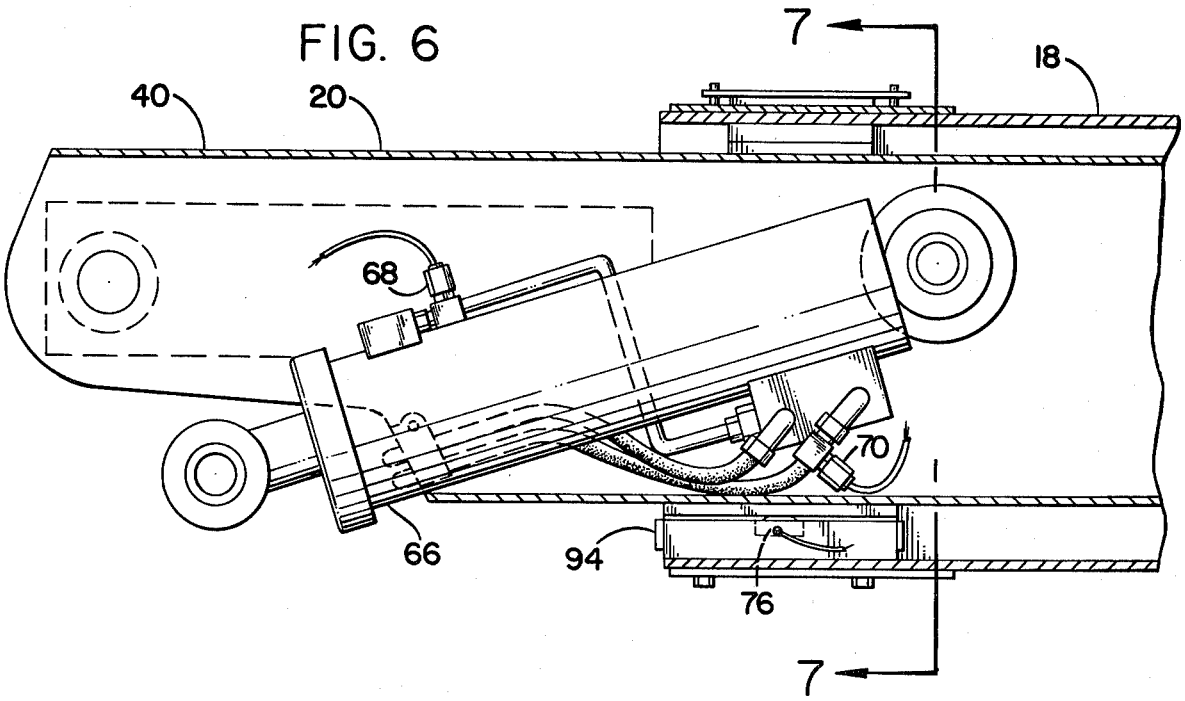

48
46
40
12
66
70
68
72
74
20
61
78
76
18
14
16
62
63
64
58
65
60
84
88
90
82
86
WARNING
OPERATE
TEST
LOAD
CAUTION
80
92
74
72
68
70

CONTROL SYSTEM FOR AERIAL WORK PLATFORM MACHINE AND METHOD OF CONTROLLING AN AERIAL WORK PLATFORM MACHINE

FIELD OF THE INVENTION

This invention is in the general field of aerial work platform machines for use by workmen to reach high elevations, and specifically relates to an electronic system allowing measurement and control over the machine in an overload condition and the tipping of the machine.

BACKGROUND OF THE INVENTION

Aerial work platform machines are used in the construction industry, agriculture, manufacturing businesses, and other industries to allow workmen to perform tasks high above the ground. The work platform machine is a type of man lifting equipment which allows a workman to move horizontally to a job site and to rise vertically to the work. A work platform machine typically has a platform for workmen to stand on, and a boom supporting the platform and having sections which telescope to extend the length of the boom. The boom is connected to pivot on a counterweighted base so that the platform can be raised by pivoting the boom, up from the base. The counterweighted base includes a turntable which is on a truck with wheels so that the base may rotate horizontally. The wheels of the truck may be steered by the workmen from the platform so that the machine may be moved about across the ground when the boom is elevated. The workmen also control, from the platform, the extension of the boom and the pivoting of the boom on the base. Manually operable actuation controls are provided on the platform so that control settings may be made by the machine operator to control the boom length, boom angle, base rotation, and movement of the truck.

The aerial work platform machine also preferably has a master leveling hydraulic cylinder mounted between the boom and the base and hydraulically connected to a slave leveling hydraulic cylinder connected between the boom and the platform. The purpose of the master and slave leveling cylinders is to keep the work platform level as the platform is moved up and down by the boom pivoting on the base.

The shape and construction of platforms for aerial work platform machines is dictated by the job to be performed and the needs of workmen who will use the machine. A standard size of platform used may be 30 inches wide and 48, 60, or 96 inches long, and is generally suitable for supporting one or two workmen with tools. A larger size of platform used may be 90 inches wide and 60 inches long to allow workmen to move about on the platform and perform tasks without moving the aerial work platform machine. The standard sized platforms may be pivotably mounted on the upper boom end to rotate horizontally. One task which a machine model which allows horizontal rotation of the platform is particularly useful for is the painting of a side of a building. For such a painting job, the platform may be moved horizontally and vertically across the side of the building by the boom, and the platform may be rotatably adjusted to always face the side of the building.

The booms of aerial work platform machines typically consist of two or more sections which telescope together so that the length of the boom may be adjusted by sliding the sections apart or together. Machines may be obtained in models having maximum boom lengths of 32, 42, 50 and 60 feet. Booms in aerial work platform machines provided by the Snorkel Division of Figgie International Inc. of St. Joseph, Mo. also are connected to a linkage assembly inside the boom sections and connected to the counterweight base so that the length of the boom is automatically changed as the boom is pivoted vertically. The linkage automatically retracts the boom approximately four feet as the boom is lowered on 42, 50 and 60 foot models and approximately two feet on 32 foot models. Machines having such linkages are disclosed in U.S. Pat. No. 4,185,426, which is incorporated herein by reference. The complicated arrangement of linkages, boom extending hydraulic cylinders, hydraulic leveling cylinders, and boom lifting cylinders makes the mounting of transducers near the base of the boom to make meaningful measurements very difficult. Since each mechanical connection made to the base of the boom contributes forces and/or moments, a transducer mounted near the base of the boom is likely to be responsive to such contributions, thus complicating the interpretation of measurements made by such transducers.

It is important in the design of aerial work platform machines to keep the overall weight of the machine as small as possible so that smaller, less expensive hauling equipment may be used to transport the machine to and from job sites. A smaller overall weight of the machine also gives the machine better gradeability in traveling from one work station to another on less than ideal job sites, allows the machine to climb steeper grades, and allows the machine to drive itself up ramps onto trailers, or hauling equipment.

A particular problem which occurs with aerial work platform machines is that the machines will tip or overturn if not properly controlled. It is very dangerous to allow a work platform machine to tip over, since workmen on the platform may be injured and the machine itself may be damaged. The tipping or overturning of a work platform machine depends upon the weight of people or things on the platform, the location on the platform of the people or things, the angular position of the boom, and the extent of elongation of the boom. To a lesser extent, tipping or overturning of the aerial work platform machine will be influenced by tilting of the counterweighted base, as when the truck is driven over uneven ground.

Because workers may move around on aerial work platforms and represent a live load, the problem of preventing tipping of the machine is made very difficult. The live load problem is made more difficult by the larger-size platforms which give workmen more room in which to move. A platform which rotates horizontally also changes the tipping tendency of the machine as the platform is rotated.

One known way of reducing the tipping tendency of aerial work platform machines is to increase the weight provided for balancing in the counterweighted base. However, as explained above, increased weight reduces the performance of the machine. The linkage assembly explained above may be used to reduce the tipping tendency of a machine by automatically shortening the boom length as the boom is lowered towards horizontal. The platform weight carrying capacity is the weight which, under safe operating conditions, is smaller than the weight which would cause machine tipping. The platform capacity depends upon the vertical elevation angle of the boom, the length of boom extension, and the position of weight on the platform.

In addition to avoiding the tipping of the aerial work platform machine, it is important to avoid damage to the machine itself caused by putting too much weight on the platform. That is, even though the machine may be in no danger of tipping in certain positions, too much weight on the platform may damage the platform itself, the boom segments, the turntable between the counterweight base and the truck, or the rotation bearing on machines having horizontally rotatable platforms. It therefore is desirable to prevent too much weight from being placed on the platform so that damage to the machine is avoided.

A known way of preventing the tipping of aerial work platform machines and preventing structural damage to the machines is to specify a maximum platform weight that will be safe regardless of the boom position, boom length, or position of the weight on the platform. The drawback to specifying such a maximum platform weight is that the specified weight is much lower than the weight that the macine will safely handle. For example, a machine having a specified maximum weight of 500 pounds may safely accommodate 1200 pounds for most boom positions, boom lengths, or positions of the weight on the platform. By using a low specified maximum platform weight, full use of the machine is not obtained and the usefulness of the machine is decreased.

A known way of manually monitoring the position of an aerial work platform machine in order to help prevent tipping is to place colored bands on a section of the boom and also position a hanging plumb bob on the boom. As the length of the boom is changed, different ones of the colored bands are exposed, thus visually displaying the length of the boom. The position of the plumb bob may be observed to determine the vertical elevation angle of the boom. Charts are provided with the machine which allow the operator to manually determine the maximum permissible weight for each combination of boom length and boom angle. The maximum permissible weight determined from the chart is the largest safe weight that avoids tipping or damage to the machine. The manual monitoring system described above has many drawbacks in that it requires the making of many tedious observations and determinations, requires use by a skilled operator who must be trained to make the observations and determinations, and requires cumbersome charts. A further drawback of the manual monitoring system is that it fails to account for the position of the weight on the platform which is important to avoid tipping and is subject to damage and defacing which renders the system difficult to use or inaccurate.

The maximum platform weight specification and manual monitoring system described above are both passive, non-automatic methods which may be overlooked or ignored by careless operators. Using these prior methods, operators may be unaware of the actual weight of people and things placed on the platform. Even though the machine may be marked with very clear warnings, reckless users may ignore the warnings and may not make the observations and determinations required for the manual monitoring system. Because safety in the use of aerial work platform machines is of great importance, it is desirable to prevent accidents caused by careless inattentive operators or reckless operators.

Computerized overload warning systems are known for use with cranes to prevent tipping of the crane and structural damaged caused by overload. The crane warning systems use a load sensing make-up pin, a boom angle sensing pendulum transducer, and a cable and reel type boom length sensor. For hydraulic cranes, a load sensor is used to replace the standard boom hoist cylinder pin. Cranes having a hydraulic cylinder mounted between the boom and the base of the crane may be equipped with one or more pressure transducers to measure the pressure of fluid in the hydraulic cylinder. Known crane warning systems may include solid state memories programmed with computer generated tables calculated from data obtained from the crane manufacturer. Crane systems may have digital displays and warning lights to warn the crane operator of unsafe conditions.

Since cranes are designed to move tools vertically straight up and down with cables and hooks, the tipping and structural damage problems encountered are quite different from those faced in the use of aerial work platform machines. In particular, cranes do not have work platforms supporting a live load at the end of a boom, so a crane overload warning system need not take account of the movements of workmen on a platform. The fact that cranes have a pulley fixed to the end of a boom and the lifting loads are always provided straight vertically down from the pulley simplifies the prevention of tipping and structural damage in cranes. Also, the weight of items lifted by a crane may be simply determined by measuring the tension in the cables used for lifting; which is not true for aerial work platforms.

SUMMARY OF THE INVENTION

This invention concerns a control system for an aerial work platform machine. The control system continuously, automatically responds to the condition of the machine and to people and things on the platform of the machine in order to avoid tipping or structural damage to the machine. The control system may be installed to easily retrofit existing machines or may be installed as a part of the manufacture of new machines.

The control system uses a programmed digital computer to take samples, through an analog-to-digital converter, of readings from transducers which measure the status of the aerial work platform machine. The computer is also connected to indicator lights, a digital display, and an audible alarm to inform the machine operator about the weight carried by the platform and the safety of the machine. The computer controls cutout relays connected to the machine actuation equipment so that the machine is prevented from being placed into an unsafe position. The cutout relays, when opened by the computer, prevent the boom from being extended in length, and prevent the boom from being lowered by pivoting to a more horizontal angle. That is, when the cutout relays are opened by the computer, the boom is allowed to move only by retracting its length or rising by pivoting to a more vertical angle. The purpose of opening the cutout relays is to help prevent the machine from being placed in a less safe condition, regardless of actuation control settings made by the machine operator. The computer, acting through the cutout relays, overrides errors made by the machine operator which could cause the tipping of or structural damage to the machine.

The control system computer is connected to a group of manually settable switches which may be adjusted by the machine operator to cause the computer to display various types of information, to calibrate the control system, or to set up the control system for various types and sizes of aerial work platform machines. A clock is provided for use by the computer and the analog to digital converter so that the transducers are sampled and so that the computer goes through programmed steps when the aerial work machine is operating.

The computer is a microprocessor having read only memory for storing a preprogrammed sequence of steps and having random access memory for storing transducer samples and other changing data. The computer executes instructions which acquire data from the transducers, analyze the data, and control the indicator lights, display, audible alarm, and cutout relays in response to the transducer data. The pre-programmed instructions serve to help insure that the aerial work platform machine is operated in a safe manner.

The computer instruction steps use known techniques of digital filtering to remove undesirable noise and variations in the data sampled from the transducers. The computer instruction steps analyze the transducer data to determine the permissible weight of people and things on the platform (maximum allowable load) for the particular, instantaneous position of the boom and the length of the boom. The maximum allowable load is the weight which, under a prespecified margin of safety, will not result in the tipping of or structural damage to the machine. The computer instruction steps further analyze the transducer data to determine the actual weight of people and things on the platform. After analyzing the transducer data to determine the permissible weight and actual weight on the platform, the computer compares the actual weight to the permissible weight. If the actual weight is found to approach or exceed the permissible weight by prespecified amounts, the computer may cause the indicators to light, the alarm to sound, or the cutout relays to open.

The actual weight determined by the computer is presented on the digital display so that the machine operator can easily determine the amount of weight on the platform without using inconvenient weighing scales or inaccurate guessing methods. This determination and display of the actual weight is important to inform the operator as to when the load carrying capacity of the machine has been exceeded and to inform the operator concerning the amount of load carrying capacity used.

The steps used by the control system to determine the permissible weight and actual weight on the platform take account of the particular size and configuration of the aerial work platform machines by using an appropriate set of machine data. The appropriate set of machine data is selected from the sets of machine data stored in read only memory and allows the measured transducer data to be analyzed properly by the computer for the particular aerial work platform machine. The stored machine data is preprogrammed into read only memory based on the manufacturer's design specifications for the various aerial work platform machines with which the control system is to work. The selection of the particular set of machine data by the computer is controlled by manually operable switches connected to the computer.

Because the control system continuously monitors the permissible weight (or maximum allowable load), weights larger than the previously used maximum platform weight specification (as explained above) may be safely carried on the platform and the usefulness of the machine is greatly enhanced. The control system of this invention allows the load carrying capacity of the machine to be effectively increased (beyond the previously used maximum weight specification) without requiring an undesirable increase in the weight of the machine itself. The control system of this invention is easy to use, and does not require a highly skilled or highly trained operator. Tedious and time-consuming work by an operator is not required by the control system of this invention because of its automatic operation.

Analog interface circuitry is provided between the transducers and the computer analog-to-digital converter. The analog circuitry amplifies electrical signals from the transducers and filters the signals to remove unwanted noise. Because the control system is to be used outdoors in the field and nearby to large sources of electrical interference, analog filtering is provided by the interface circuitry and digital filtering is provided by the computer.

The transducers used include a cable type displacement transducer for measuring the boom length, a pendulum transducer for measuring the angle of the boom, load cells mounted inside the boom to measure the lateral force exerted by one telescoping boom section on an adjacent boom section, and a pair of hydraulic fluid pressure transducers for measuring the hydraulic pressure at the slave hydraulic cylinder mounted between the boom and platform to keep the platform level. The arrangement of transducers used is particularly advantageous in that high accuracy is obtained and no transducer cables need be strung along the awkward connection between the boom and the base. The transducers used are easily attached to retrofit existing aerial work platform machines and are of relatively low cost.

The actual weight determination made automatically by the computer of this control system is made by solving simultaneous equations for the data produced by the transducers attached to the slave hydraulic cylinder and by the load cell transducers inside the boom.

The placement of load cell transducers inside the boom, underneath slides which provide sliding contact between the adjacent telescoping boom sections is particularly important to this invention. The load cells used are less expensive than clevis-pin type transducers and are insensitive to extraneous stresses produced by equipment such as boom lifting hydraulic cylinders, master leveling hydraulic cylinders, and linkage assemblies inside the boom. The load cell transducers are positioned under the boom slides to detect the torsional bending stresses in the boom and to ignore stresses along the length of the boom.

DESCRIPTION OF THE DRAWINGS

FIG. 1 is a perspective view of the aerial work platform machine having a rotatable work platform mounted on a boom, and showing the work platform rotated to a phantom position.

FIG. 2 is an overhead plan view of the boom and work platform of the aerial work platform machine showing the boom in a retracted position.

FIG. 3 is a side elevational view of the aerial work platform machine showing, in phantom, the boom extended and pivoted to various positions. The machine shown in FIG. 3 has a larger size of platform than standard.

FIG. 6 is a partially cut away side cross sectional view of the upper end of the boom of the aerial work platform machine showing the slave hydraulic leveling cylinder.

DESCRIPTION OF THE PREFERRED EMBODIMENT

Figures 4, 5:
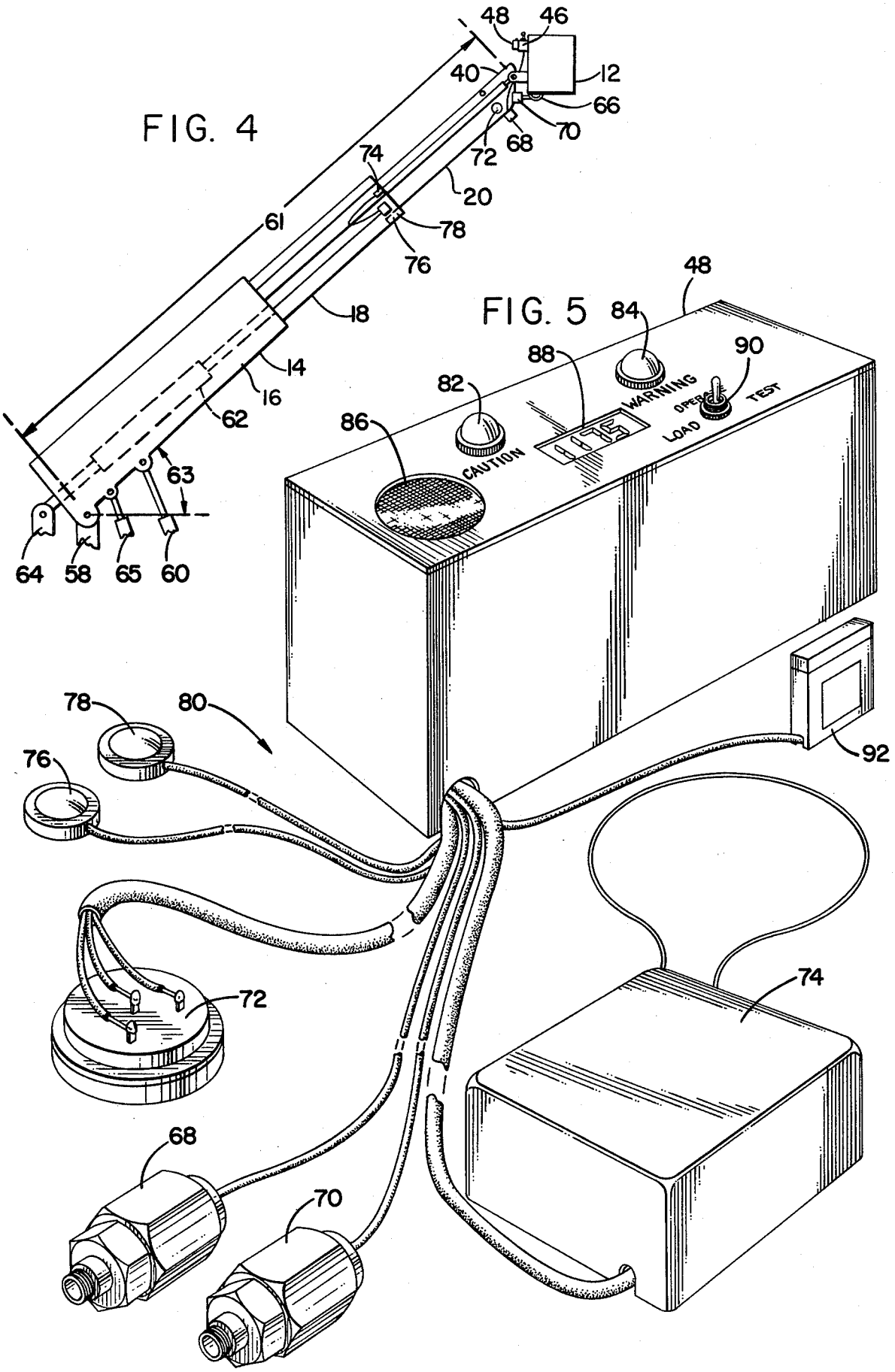
FIG. 4 is a side view of the boom of the aerial work platform machine.
FIG. 5 is a perspective drawing of the components of the control system of this invention shown removed from the aerial work platform machine.

Referring first to FIG. 1, the aerial work platform machine 10 includes a work platform 12 for workmen to stand on, and a boom 14 supporting the platform 12 and having sections 16, 18, and 20 which telescope to extend the length of the boom 14. Booms may be made for various models of the machine 10 in extended lengths of 30 feet, 40 feet, 50 feet, 60 feet or 70 feet. The boom 14 is connected to pivot on the counterweighted base 22 so that the platform 12 can be raised upwards by pivoting the boom 14 up from the base 22. The counterweighted base 22 includes a turntable 24 which is on a truck 26 with wheels 28, 30, 32 and 34 so that the base 22 may rotate horizontally on the truck 26. The directions of horizontal rotation of the base 22 are shown by the arrows 36 and 38.

The work platform 12 is pivotably mounted on the upper end 40 of the boom 14. The work platform 12 may be rotated horizontally on the upper boom end 40 in the directions shown by the arrows 42 and 44.

A movement control box 46 is mounted in the work platform 12 and allows workmen to control, from the platform 12, the length of extension of the boom 14 and the pivoting of the boom 14 on the base 22. The control box 46 also allows control over the steering and the driving of the wheels 28, 30, 32 and 34. The control box 46 further allows workmen to control rotation of the platform 12 and rotation of the base 22.

The safety control box 48 is mounted in the work platform 12 and is a part of the control system of this invention. The safety control box 48 is positioned for easy access by workmen on the work platform 12.

The platform 12 may be rotated on the upper boom end 40 to a position 12A (shown in phantom). A platform in the position 12A will have less of a tendency to tip the machine 10 than a platform in the position 12. Tipping of the machine 10 may result when the wheels 32 and 34 are lifted from the ground 52 and the machine 10 is urged to tip over by pivoting over the wheels 28 and 30.

Referring next to FIG. 2, the control box 46 includes joystick controls for controlling the angle of the boom 14 and rotation of the base 22, and for controlling the movement and steering of the wheels 28, 30, 32, and 34. The control box 46 includes further controls for adjusting the extension of the boom 14 and controlling the operation of an internal combustion engine inside the base 22.

A telescoping cable conduit 47 is connected to each of the sections 16, 18, and 20 and serves to protect hydraulic and electrical lines extending along the boom 14, between the base 22 and the work platform 12.

Referring next to FIG. 3, a larger work platform 50 (in comparison to platform 12) is in place on the machine 10. The larger platform 50 is particularly advantageous when many workmen are to be lifted or when the workmen must move around on the platform 50 in order to perform the task.

The boom 14 is shown in phantom at 14A and 14B in two different pivoted positions up from the base 22. The length of the boom has been extended in the position 14A in comparison to the length of the boom in position 14. The positions of the platform 50 shown at 50A and 50B correspond to the positions of the boom 14 shown at positions shown at 14A and 14B, respectively.

The position of the platform at 50A is more likely to cause the tipping of, or structural damage to the machine 10 than the position of the plaform shown at 50. By extending the boom from position 14 to position 14A, the likelihood that the machine 10 will be tipped by lifting the wheel 30 off of the ground 52 is increased.

The position of the platform at 50B is less likely to result in the tipping of or structural damage to the machine 10 than the position of the boom at 50A. Because the boom has been pivoted upwards from position 14A to position 14B, the likelihood of the tipping of machine 10 is reduced.

The workmen 54 and 56 on the platform 50 are free to move about the platform 50 when the machine 10 is in use. A workman standing in the position 54 will have more of a tendency to tip the machine 10 than a workman standing in the position 56.

Referring next to FIG. 4, the boom 14 pivots on the pivot linkage 58 of the base 22 (see FIG. 1). A hydraulic lifting cylinder 60 is provided to control the pivoting of boom 14 on the linkage 58. A boom length extension cylinder 62 is mounted inside the boom 14, and is connected between the section 20 and the extension linkage 64 of the base 22 (see FIG. 1). Actuation of the hydraulic cylinder 62 controls the length of the boom 14 by causing the sections 16, 18, and 20 to telescopically extend and retract. The extension linkage 64 is positioned to cause the boom 14 to automatically lengthen as the boom 14 is pivoted upwards by the cylinder 60. A master hydraulic leveling cylinder 65 is connected between the boom 14 and the base 22. The master leveling cylinder 65 is hydraulically coupled to the slave leveling cylinder 66. The slave leveling cylinder 66 is connected between the work platform 12 and the upper boom end 40. The function of the master and slave leveling cylinders 65 and 66 is to automatically keep the work platform level as the boom 14 is pivoted by the lifting cylinder 60. The cylinders 60, 62, and 65 and the linkages 58 and 64 are of the type described in the background section hereof as contributing forces and moments which would make difficult the evaluation of measurements made by transducers located near the base of the boom 14. In contrast, the placement of the load cells 76 and 78 inside the boom 14 simplifies the task of interpreting transducer measurements.

The safety control box 48 is electrically connected to pressure transducers 68 and 70, angle sensor 72, boom length sensor 74, and load cells 76 and 78. The angle sensor 72 is mounted on the boom 14, near the upper end 40 thereof. The function of pressure transducers 68 and 70 is to measure the pressure across the slave leveling cylinder 66 as an indication of the force required to keep the platform 12 level. The function of the angle sensor 72 is to detect the angle between the boom 14 and horizontal. The function of the boom length sensor 74 is to detect the length to which the boom 14 has been extended. The function of the load cells 76 and 78 is to detect the downward, sideways forces between the sections 18 and 20 of the boom 14 and to thus detect the shearing force inside the boom 14.

The function of the safety control box 48 is to analyze the information detected by the sensors 68, 70, 72, 74, 76 and 78. The safety control box 48 also exerts control over the functions performed by control box 46 so that the machine 10 is prevented from being placed in an unsafe position by a workman and the workman is warned when his operation of the machine 10 approaches an unsafe position.

The length of the boom 14 extends the distance denoted 61 extending from the pivot of the section 16 on the linkage 58 of the base 22 to the pivot of the platform 12 cn the end 40 of the section 20. The boom 14 includes internal cable and pulley mechanisms so that as the length of the extension cylinder 62 is changed, the sections 18 and 20 are caused to slidably move by predetermined differing proportionate amounts of distance so that the boom 14 telescopes evenly as its length is changed. The angle denoted 63 is the elevational angle between the boom 14 and horizontal.

Referring next to FIG. 5, the safety control system 80 of this invention includes the safety control box 48, pressure transducers 68 and 70, angle sensor 72, boom length sensor 74, and load cells 76 and 78. The components of the safety control system 80 are connected together by electrical cables which are to be strung along the boom 14.

The pressure transducers 68 and 70 are standard, commercially available hydraulic pressure transducers for use in measuring the pressure of hydraulic fluid across a hydraulic cylinder. The angle position sensor 72 is a standard, commercially available pendulum type angle position sensor. The boom length sensor 74 is a standard, commercially available device having a reel and a retractable cable for mounting on and measuring the length of the boom 14. The load cells 76 and 78 are standard, commercially available load cells (sometimes called force washers) which are positioned inside boom slides to measure the bearing force between adjacent sections of the boom 14.

The safety control box 48 includes a caution light 82 and a warning light 84. The function of the lights 82 and 84 is to inform the operator of the aerial work platform machine 10 when the machine 10 is approaching its limits of safe operation. Preferably, the yellow caution light 82 is caused to turn on when the machine 10 approaches eighty-five percent (85%) of its maximum allowable load. The red warning light 84 is preferably caused to come on when the machine 10 approaches one hundred percent (100%) of its maximum allowable load. The audible alarm 86 is a part of the safety control box 48 which preferably is actuated at the same time that the warning light 84 turns on.

The digital display 88 is a part of the safety control box 48 which presents a visual display of the maximum allowable load corresponding to the instantaneous position of the aerial work platform machine 10. Through the use of the switch 90, the display 88 may also be used for testing and calibration purposes so that proper operation of the safety control system 80 may be verified and so that the transducers 68, 70, 72, 74, 76 and 78 may be calibrated.

The connector box 92 is attached to the safety control box 48 by a cable and transfers DC power to the control box 48 from the machine 10. The connector box 92 also includes cutout relays connected to the controls of the aerial work platform machine 10 so that, when the cutout relay is actuated, the machine 10 may not be operated to move to a less safe position. It is preferable that the cutout relays of the connector box 92 be caused to operate when the aerial work platform machine reaches one hundred and five percent of its maximum allowable load.

The cutout relays of the connector box 92 are electrically connected to the controls housed in the control box 46 (see FIG. 2) and are connected in series with the controls governing the downward pivoting of the boom 14 on the base 22 and the controls governing the telescope length extension of the boom 14. Therefore, the cutout relays of the box 92, when actuated, prevent the control box 46 from exerting usual control over the movement of the machine 10 and further downward pivoting of the boom 14 on the base 22 is prevented and further extension of the length of the boom 14 is prevented.

Referring next to FIG. 6, the slave leveling cylinder 66 is mounted inside the section 20 and is attached to control the tilting of the work platform 12 (see FIG. 4). The pressure transducers 68 and 70 are mounted on opposite sides of the ram of the slave hydraulic cylinder 66 and thus serve to measure the force exerted by the slave leveling cylinder 66 required to keep the platform 12 level. The slave hydraulic cylinder 66 preferably includes a check valve arrangement which prevents fluid flow into or out of the cylinder 66 when the position of the machine 10 is not changed. The check valving arrangement used with the slave leveling cylinder 66 insures that the platform 12 will remain level as the load on the platform is changed, as by workmen moving around on the platform 12. It is because of the check valving arrangement used that two pressure transducers (such as 68 and 70) are required to measure the force provided by the leveling cylinder 66.

The section 20 is supported inside the section 18 by a slide 94 which serves as a pressure pad for the section 20 and as a sliding surface for the section 20. The load cell 76 is positioned inside the slide 94 and serves to measure the transverse pressure exerted on the inside of section 18 by the section 20.

Figure 7:
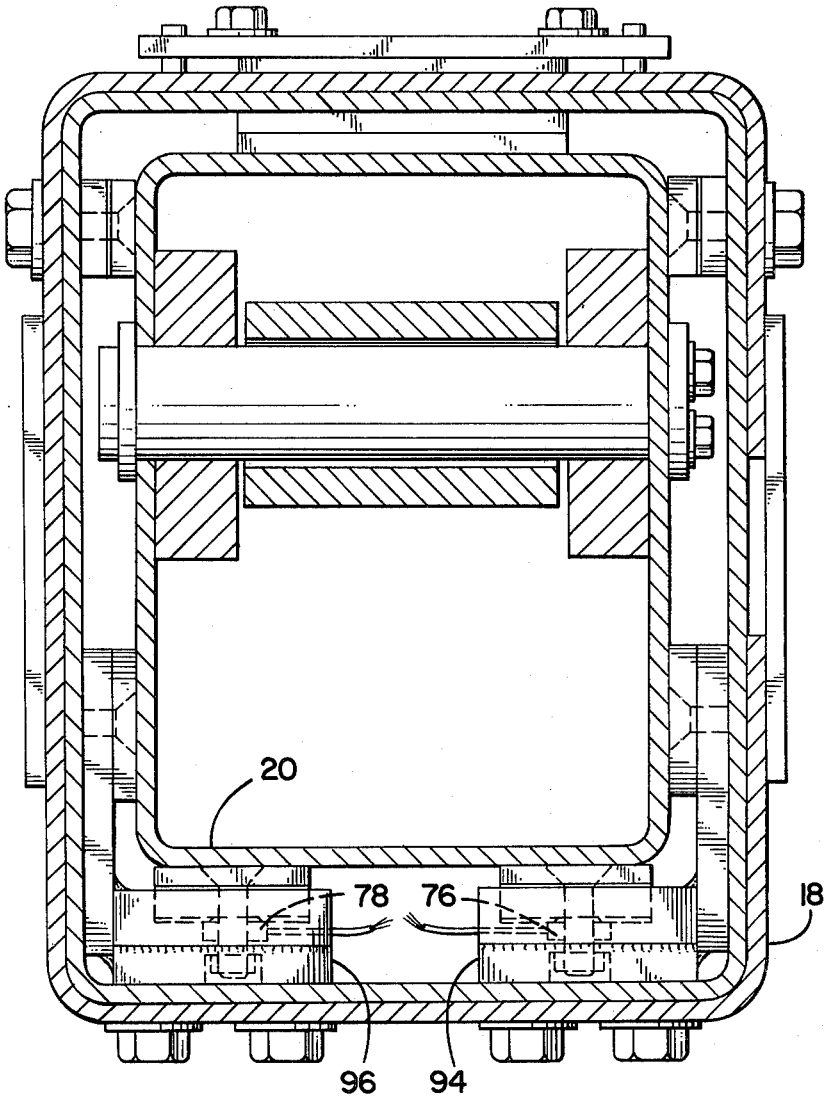
FIG. 7 is a cross sectional view of the boom of the aerial work platform machine taken along the lines 7—7 of FIG. 6.

Referring next to FIG. 7, the telescoping connection between the sections 18 and 20 is shown. The slide 96 is substantially identical in construction to the slide 94. The slides 94 and 96 are mounted beneath and on opposite sides of the section 20 and serve to confine the section 20 to sliding movement along the length of the section 20. The slides 94 and 96 are securely attached to the section 18 and transfer support forces from the section 18 to the section 20. The load cell 78 is mounted inside the slide 96 in substantially the same way that the load cell 76 is mounted inside the slide 94.

The function of the load cells 76 and 78 is to measure support forces provided by the section 18 to the section 20. Because the load cells 76 and 78 are positioned inside the slides 94 and 96, respectively, the load cells 76 and 78 measure downward forces which are perpendicular to the lengths of the sections 18 and 20. The forces sensed by the load cells 76 and 78 are responsive to the weight of items carried by the work platform 12 (see FIG. 1), and the position of the weight carried by the work platform 12. The forces measured by the load cells 76 and 78 also are responsive to the length of the boom 14 and the angle of the boom 14 with respect to horizontal.

Figure 8:
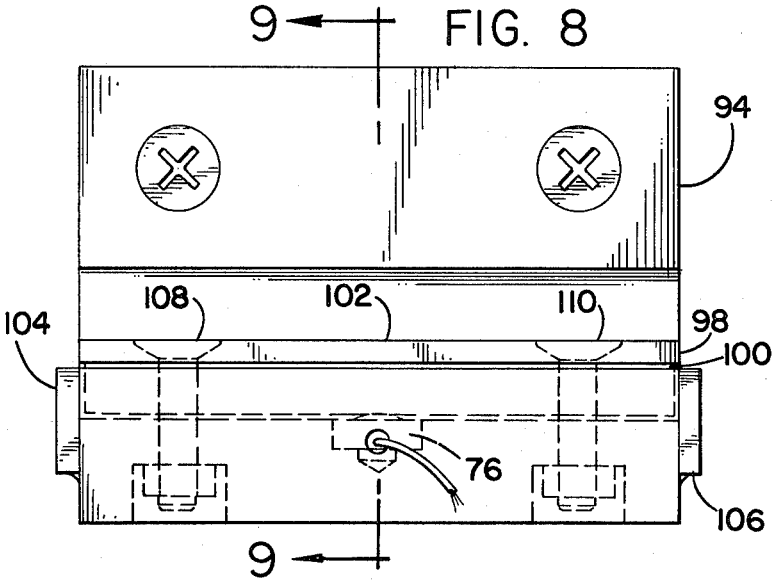
FIG. 8 is a side elevational view of one of the slides for mounting inside the boom of the aerial work platform machine.
Figure 9:
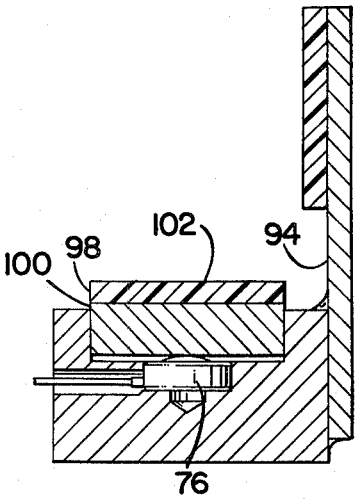
FIG. 9 is a cross sectional view of the slide of FIG. 8 taken along the lines 9—9.

Referring next to FIGS. 8 and 9, the slide 94 is an L-shaped bracket which has a support block 98 for slidably supporting the section 20. The support block 98 includes a base 100 (preferably composed of metal) and a top 102 (preferably composed of dense plastic). The top 102 has a low coefficient of friction to allow easy sliding of the section 20.

The load cell 76 is mounted in a recess of the slide 94 beneath the base 100 so that the base 100 is supported by the load cell 76. The purpose of the load cell 76 is to measure the forces transferred perpendicularly between the base 100 and the slide 94. The load cell 76 supports the base 100 on the slide 94. End caps 104 and 106 are welded to the slide 94 to prevent the slide pad 98 from sliding out of the slide 94. Bolts 108 and 110 are connected between the slide 94 and the slide pad 98 to hold the slide pad 98 against the load cell 76 and to prevent the slide pad 98 from falling away from the slide 94.

Figure 10:
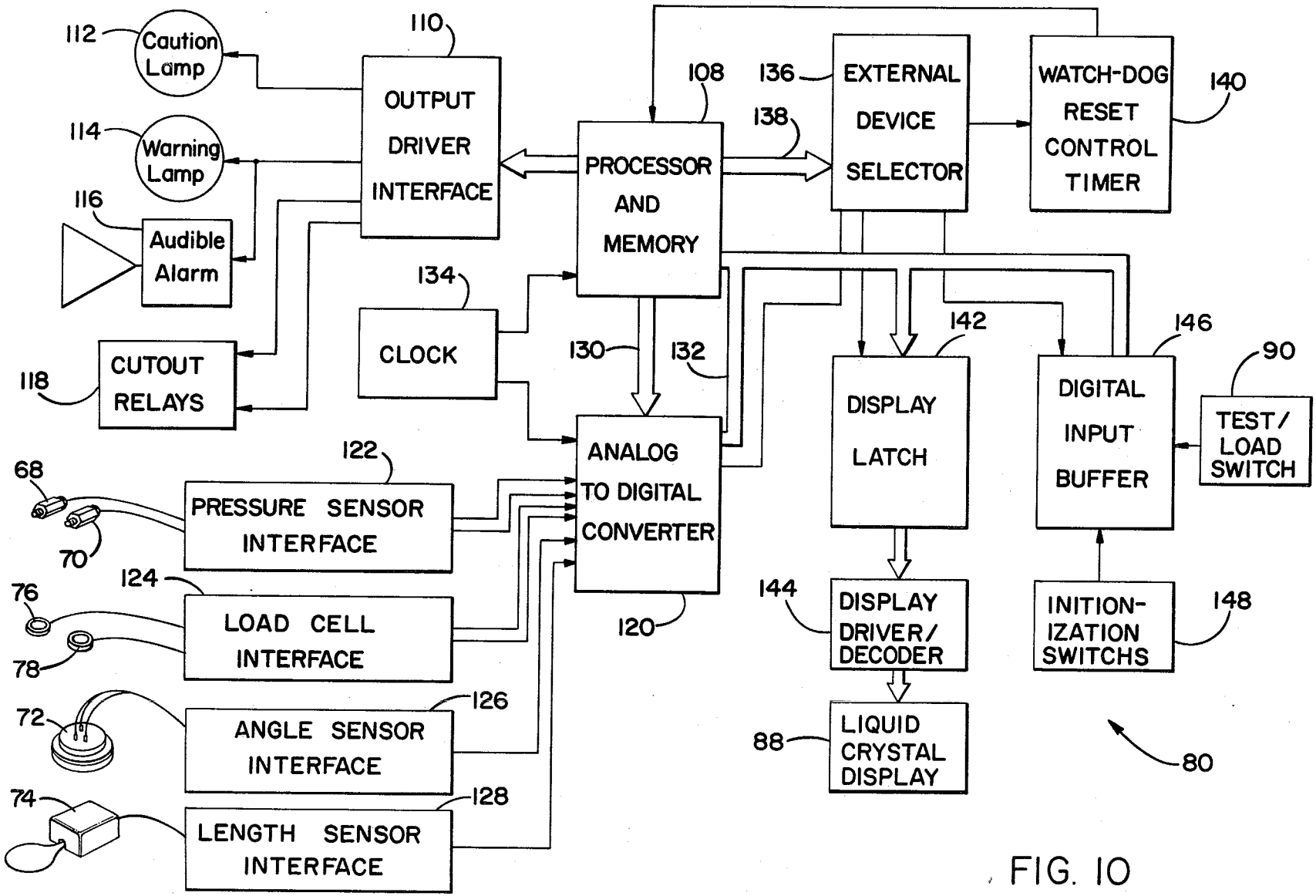
FIG. 10 is a block diagram of the electrical circuitry of the control system of this invention.

Referring next to FIG. 10, the safety control system 80 preferably uses a programmed digital computer to sense the operating conditions of the aerial work platform machine 10 and to prevent unsafe operation of the machine 10. The control system 80 preferably includes a microprocessor 108 of the commercially available type known as MC68705P3 which is commercially available from Motorola Semiconductor Products, Inc., 3501 Ed Bluestein Blvd., Austin, Tex. 78721. The construction and operation of the processor 108 is described in an advance information brochure on the MC68705P3, publication number ADI-848, published by Motorola Semiconductor Products, Inc. and which is incorporated herein by reference. The processor 108 includes, internally, read only memory portions for program storage, and random access memory portions for variable data storage.

The processor 108 is connected, through a digital output port, to an output driver interface 110 which preferably comprises a plurality of type 75476 relay drivers. The interface 110 allows the processor 108 to control the actuation of a caution lamp 112, a warning lamp 114, an audible alarm 116, and cut out relays 118. The lamp 112, lamp 114, and alarm 116 correspond to the lamp 82, lamp 84 and alarm 86, respectively, shown in FIG. 5 hereof. The cutout relays 118 correspond to the relays shown at 92 in FIG. 5 and allow the microprocessor 108 to control the operation of the aerial work platform machine 10 so that the machine 10 is automatically prevented from being placed in an unsafe condition.

An analog to digital converter 120 is connected to the processor 108 so that control information is passed on to processor 108 from the converter 120 and so that digital information produced from analog signals by the converter 120 is passed to the processor 108. The analog to digital converter 120 is preferably a commercially available ADC0808 which is a product of the National Semiconductor Corporation. An improved version of the control system 80 might be constructed through the use of a commercially available microprocessor denoted MC6805R2 which integrates the functions performed by processor 108 and converter 120 and which is available from Motorola Semiconductor Products, Inc. The interfaces 122, 124, 126 and 128 are electrically connected to the converter 120 to provide analog signals to the converter 120 which have been appropriately amplified and offset. Instructions relating to which of the interfaces 122, 124, 126 or 128 is to be sampled and when the sampling is to occur is placed on the bus 130 by the processor 108. Digital data produced by the converter 120 is placed on the bus 132 so that the digital data may be received by the processor 108.

The timing of operations performed by the processor 108 and by the converter 120 is controlled by the clock 134 which provides a four megahertz clocking signal to the processor 108 and which provides a one megahertz clocking signal to the converter 120. The operation of the clock 134 is crystal controlled to insure accuracy.

An external device selector 136 is connected to the processor 108 through a bus 138 and operates under the control of the processor 108. The selector 136 preferably comprises a commercially available type 74LS139 circuit together with associated inverter logic circuits. The function of the device selector 136 is to control which of the devices receives data from or places data on the bus 132 so that the processor 108 can control the use of the bus 132. The selector 136 is connected to the converter 120 so that the converter 120 will place its digital data on the bus 132 when permitted to do so by the selector 136.

A watchdog reset control timer 140 is connected to the selector 136 and to the processor 108. The purpose of the timer 140 is to detect improper operation of the control system 80 and to cause an automatic resetting of the processor 108 when such improper operation is detected. The control timer 140 preferably reinitializes itself each time that the selector 136 causes the operation of a display latch 142. This reinitializing of the control timer 140 by the selector 136 prevents the control timer 140 from resetting the processor 108. The selecting of the display latch 142 by the device selector 136 corresponds to an updating of the liquid crystal display 88 by the processor 108. In effect, the control timer 140 detects when an unsuitably long time has elapsed between updates of the display 88 by the processor 108, and causes the processor 108 to be reset if such unsuitably long delays occur. The control timer 140 functions to restart the processor 108 if electrical noise or unforeseen circumstances cause the processor 108 to cease operating.

The display latch 142 is connected to the bus 132 and is controlled in operation by the device selector 136. The function of the display latch 142 is to receive digital information from the processor 108 through the bus 132 and to store the information. A display driver and decoder 144 is connected to the output of the display latch 142. The liquid crystal display 88 (see FIG. 5 also) is connected to the output of the driver/decoder 144. The function of the driver/decoder 144 is to convert the digital information stored by the latch 142 into a form which is appropriate to drive the liquid crystal display 88 to display digital numbers. Control over and the contents of the display 88 are controlled by the processor 108. The driver/decoder 144 preferably comprises a commercially available type ICM7211A available from the Intersil Corporation.

A digital input buffer 146 is connected to the bus 132 and operates under the control of the device selector 136. The buffer 146 preferably includes a commercially available type 74LS244 circuit and functions to buffer digital data for receipt by the processor 108. The test-/calibrate switch 90 (see also FIG. 5) is connected to the buffer 146 so that the processor 108 may detect the position of the switch 90. The initialization switches 148 are connected to the buffer 146 so that the condition of the switches 148 may be detected by the processor 108. The function of the switches 148 is to allow the operator of the machine 10 to specify the model and configuration of the machine 10 so that the processor 108 is apprised of the size of the boom 14, the type of platform 12 in use, and other details concerning the construction of the particular machine 10 to which the control system 80 is connected.

The pressure sensor interface 122 preferably includes commercially available type ICL7650 and LM324N integrated circuits which serve to amplify and condition analog signals provided by the pressure transducer 68 and 70. The interface 122 includes controls to allow the pressure transducers 68 and 70 to be properly calibrated and offset so as to provide appropriate analog voltages to the converter 120.

The load cell interface 124 includes commercially available type ICL7650 and LM324N integrated circuits together with calibration controls so that the load cells 76 and 78 are properly interfaced to the converter 120. The interfaces 126 and 128 include commercially available type LM324N integrated circuits so that the angle sensor 72 and boom length sensor 74, respectively, are properly interfaced to the converter 120. The function of the interfaces 126 and 128 is to provide appropriate voltage levels for the converter 120. Similarly, the function of interfaces 122 and 124 is to provide appropriate voltage levels for the converter 120.

Figure 11:
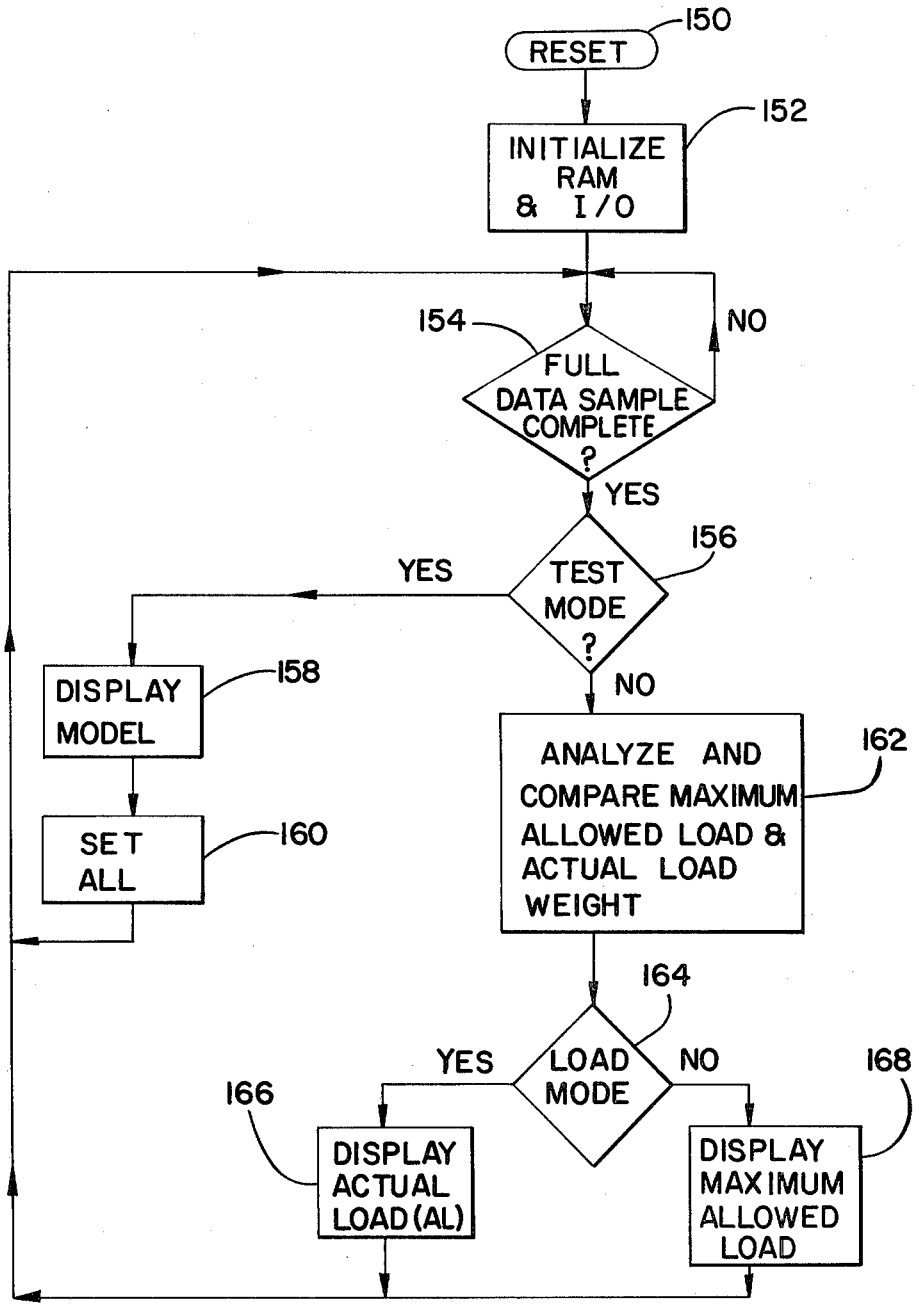
FIGS. 11 and 12 are computer program flow charts of the control system of this invention.
Figure 12:
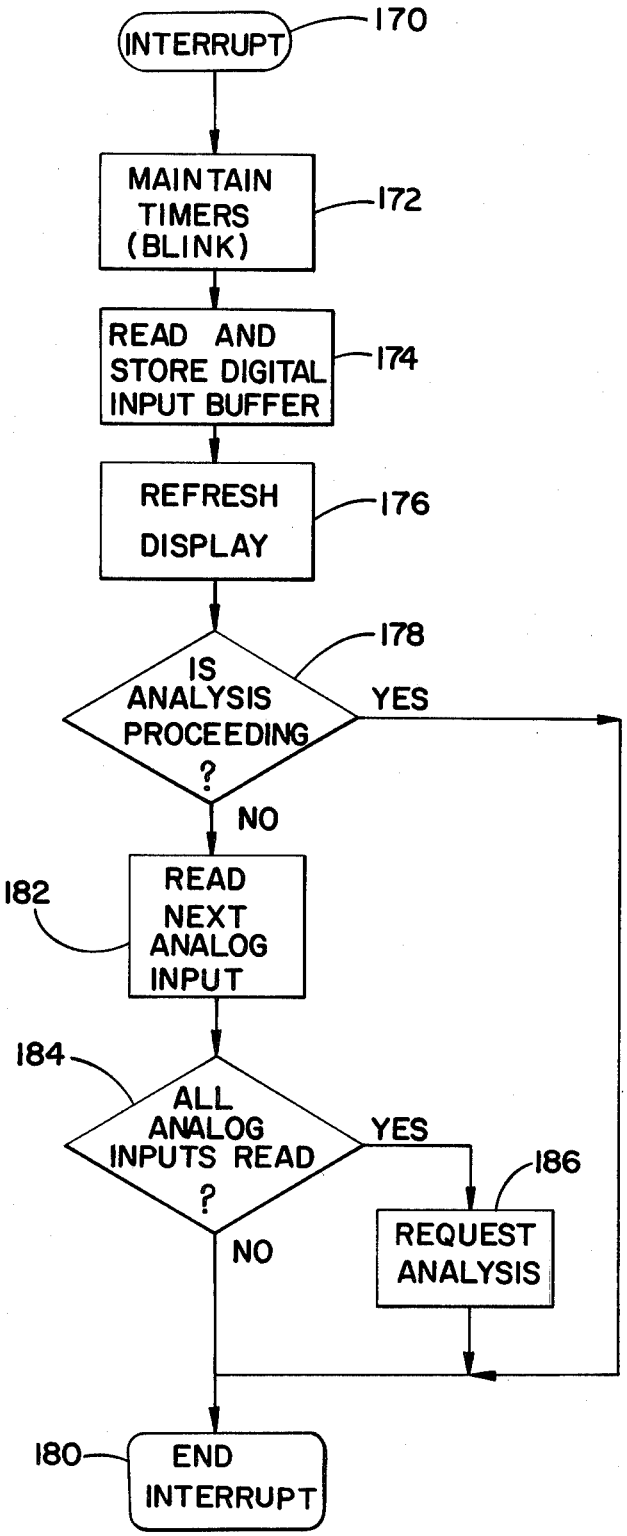

Referring next to FIG. 11, the main program flow chart disclosing the steps performed by the processor 108 during the operation of the safety control system 80 is shown. The sampling interrupt routine shown in FIG. 12 is performed periodically during the operation of the steps shown in FIG. 11 in accordance with interrupts provided to the processor 108 by the clock 134. The purpose of the steps shown in FIG. 11 is to operate the structures shown in FIG. 10 based upon the information obtained by the steps of FIG. 12. The steps disclosed in FIGS. 11 and 12 are instructions which govern the operation of the processor 108 directly and thus also control the operation of the safety control system 80 shown in FIG. 10. The steps disclosed in FIGS. 11 and 12 preferably are a firmware control program stored in the read only memory portion of the processor 108.

The reset step 150 is the starting point for the sequence of steps shown in FIG. 11 and is executed when power is initially applied to the safety control system 80 and when the watchdog reset control timer 140 detects that too long a duration for the refreshing of the display 88 has occurred.

The step 152 follows the step 150 and serves to initialize the random access memory of the processor 108 so that any temporary data stored there is erased and also serves to initialize the input/output bus 132.

The decision step 154 follows the step 152 and is set to loop back upon itself until the completion of sampling of a full data set from the digital input buffer 146 and the converter 120 has been accomplished by the processor 108 through the sequence of steps in the interrupt routine shown in FIG. 12. The step 154 insures that the further steps shown in FIG. 11 are not executed until such time as data has been stored in the random access memory of the processor 108 by the steps shown in the interrupt routine of FIG. 12.

Once the step 154 has determined that the requisite data sampling has occurred, the decision step 156 is executed to determine if the switch 90 has been placed in a test position. If the step 156 determines that the switch 90 is in a test position, the steps 158 and 160 are executed to cause the display 88 to present digits corresponding to the machine 10 model number specified by the initialization switches 148, and to actuate the lamps 112 and 114, and the alarm 116. The function of detecting a test mode in the step 156 is to allow the operator of the machine 10 to insure that the initialization switches 148 have been properly set and to further insure that the lamps 112 and 114 and the alarm 116 are in working order and that the safety control system 80 itself is operating properly.

If the decision step 156 determines that the switch 90 is not in a test position, the step 162 is executed after the step 156. The function of the step 162 is to perform computations based upon the data obtained in the steps shown in FIG. 12 in order to determine the maximum allowed load for the machine 10 based upon the position of the machine 10 as indicated by the data gathered by the steps in FIG. 12. The step 162 further performs computations to determine the actual load weight carried by the machine 10 as determined by the data obtained through the steps shown in FIG. 12. The step 162 further makes a comparison between the computed maximum allowable load and the computed actual load weight. Based upon this comparison made, the step 162 may cause the caution lamp 112 to light, the warning lamp 114 to light, the audible alarm 116 to sound, or the cutout relays 118 to actuate.

The step 162 performs the computations to determine the maximum allowable load by using data obtained from the angle sensor 72 and the boom length sensor 74 to determine the permissible operating conditions for the particular model of the machine 10 specified in the initialization switches 148.

The decision step 164 follows the step 162 and detects whether the switch 90 has been placed in a load mode position. If the step 164 determines that the switch 90 has been placed in a load mode position, the step 166 is executed to cause the display 88 to indicate the actual load weight as computed by the step 162. Execution of the step 166 causes calibration information to be presented in the display 88 in sequence at two second intervals, such information including: the actual load weight carried by the platform 12 (in pounds); the angle of the boom 14 (in tenths of degrees); the length of the boom 14 (in hundredths of feet); the forces measured by the load cells 76 and 78 (in pounds); and the pressures measured by the transducers 68 and 70 (in vpsi). If the step 164 determines that the switch 90 has not been placed in a load mode position, the step 168 is executed to cause the display 88 to indicate the maximum allowed load as computed by the step 162.

After the steps 166 or 168 have been executed, the step 154 is executed to continue the sequence of steps described above in a continuing loop of steps. Similarly, after step 160 has been executed, the step 154 is executed to continue the sequence of steps described above in a continuing loop of steps.

Referring next to FIG. 12, the interrupt entry point 170 corresponds to the start of the interrupt routine shown in FIG. 12 which is entered based upon the detection of an interrupt from the clock 134 by the processor 108. The step 172 is executed after entry into the interrupt at point 170 and functions to maintain internal blink timers in the processor 108 which are used to cause the display 88 to flash on and off whenever the warning light 84 is lit by the processor 108.

The step 174 follows the step 172 and functions to read and store the digital data from the input buffer 146 so that the positions of the switch 90 and switches 148 are stored in the random access memory of the processor 108. The purpose of obtaining the positions of the switches 148 is to indicate to the program disclosed in FIGS. 11 and 12 (particularly step 162) the particular model and configuration of the machine 10 (such as the maximum length of the boom 14, the particular type of platform 12, etc.). The positions of the switches 148 is used by the program of FIGS. 11 and 12 to decide which portions of the read only memory of the processor 108 to use in establishing appropriate parameters for use in the analysis performed by the step 162. Thus, the positions of the switches 148 are used to select which of the sets of parameters permanently stored in the read only memory of the processor 108 are to be used in controlling the operation of the machine 10.

The step 176 is executed after the step 174 and serves to cause the display 88 to be refreshed with the data stored in the random access memory of the processor 108 based upon the computations made in the step 162 of FIG. 11.

The decision step 178 follows the step 176 and determines whether the analysis performed by step 162 of FIG. 11 is proceeding at the time that the step 172 is executed. If such analysis is proceeding, the interrupt routine of FIG. 12 is terminated through the exit point 180 to resume execution of the steps of FIG. 11.

If step 178 determines that the analysis of step 162 is not proceeding, the step 182 is executed in order to read an input to the converter 120 from the interfaces 122, 124, 126 or 128. The processor 108 keeps track of which of the inputs to the converter 120 have been read so that the step 182 is caused to read the input to converter 120 in sequence by placing appropriate control signals on the bus 130.

The decision step 184 follows the step 182 and serves to determine when a complete set of the inputs to converter 120 has been read so that step 186 may be executed to cause the sequence of steps in FIG. 11 to be directed to execution of the step 162.

The computation of the actual load weight performed in step 162 proceeds by solving simultaneous equations for the loading of platform 12 as detected by the pressure transducers 68 and 70, and the force carried by the boom 14 as detected by the load cells 76 and 78. The relationship between the load carried by the platform 12 and the pressures detected by the transducers 68 and 70 is a function of the elevational angle of the boom 14 as detected by the sensor 72. The relationship between the forces measured by the cells 76 and 78 and the load carried by the platform 12 is dependent upon the elevational angle of the boom 14 as detected by the sensor 72 and upon the length of the boom 14 as detected by the sensor 74. Also, the measurements made by the sensors 68 and 70, and the cells 76 and 78 are influenced by the position of the load weight on the platform 12.

The function of the step 162 is to solve simultaneous equations which utilize the information obtained from the sensors 68 and 70 and the cells 76 and 78 in order to make a determination of the actual load weight carried by the platform 12 which is substantially uninfluenced by the position of the weight on the platform 12, or by the length of the boom 14, or elevational angle of the boom 14. The steps used in the analysis performed by the step 162 are shown below in a mathematical form which discloses, in a mathematical format, the sequential steps and methods used by the safety control system 80 to maintain the aerial work platform 10 in a safe working configuration.

| Maximum Allowable Load Analysis | | |
|---|---|---|
| MAL | = | maximum allowable load |
| WBM | = | weight of boom 14 itself (constant) |
| LBM | = | distance to center of mass of boom 14 from pivot on base 22 (directly related to the length of boom 14 measured by transducer 74) |
| WB | = | weight of the platform 12 itself (constant) |
| L | = | length of the boom 14 (directly related to measurement made by transducer 74) |
| XB | = | distance to center of mass of platform 12 from pivot on end 40 of boom 14 (constant) |
| WL | = | weight of load on platform 12 |
| WL(WC) | = | worst case weight of load on platform 12 (predefined constant) |
| XL | = | distance to center of mass of load weight on platform 12 from pivot on end 40 of boom 14 |
| Working Moment | = | figure representing the worst case configuration for the machine 10 with the beam 14 fully extended and the beam 14 at a horizontal angle |
| Working Moment* | = | $WBM \times LBM + WB \times (L + XB) + WL(WC) \times (L + XL)$ *computed at worst case configuration, with XL chosen to be consistent with the design and safety margin of the serial work platform machine 10 |
| MAL** | = | $\frac{\text{Working Moment} - WBM \times LBM - WB(L + XB)}{(L + XL)}$ |

-continued

| Maximum Allowable Load Analysis |
|---|
| and MAL is limited to be less than a predetermined value (preferably 1200 pounds) to avoid damage to the machine 10 |

The maximum allowable load analysis outlined above is performed in order to determine the largest permissable load weight which may be safely placed on the platform 12. The maximum allowable load is responsive to the angular elevation of the boom 14, the length of extension of the boom 14, and the position of the load weight on the platform 12. That is, the maximum allowable load will decrease as the angular elevation of the boom 14 is decreased (i.e., as the boom 14 is pivoted downwards). The maximum allowable load will decrease as the length of the boom 14 is increased (i.e., as the boom 14 is extended). Also, the maximum allowable load will decrease as the load weight is moved outwards on the platform 12, horizontally away from the base 22. Thus, if a workman standing on the platform 12 steps backwards, away from the base 22, the maximum allowable load will decrease. It is possible that the moving of a load weight on the platform 12 may change the operation of the machine 10 from a safe to a less safe condition such that the lamp 82 or 84 or alarm 86 or cutout relays 92 may be actuated because of the movement.

The maximum allowable load analysis proceeds by subtracting moments related to the measured position of the machine 10 from a computed worst case working moment for the particular model and configuration of the machine 10. The analysis concludes by dividing the computed difference by the sum of the length of the boom and the distance from the end 40 of the boom 14 to the center of mass of the load weight.

| Actual Load Analysis | | |
|---|---|---|
| FF | = | composite force inside boom 14 (measured by the load cells 76 and 78) |
| LF | = | distance to the load cells 76 and 78 from the lower end of the section 20 inside boom 14 (directly related to the length of boom 14 as measured by transducer 74) |
| FH | = | force supplied by slave leveling cylinder 66 (as measured by sensors 68 and 70) |
| LH | = | vertical distance between the point of application of FH on platform 12 and pivot point of platform on end 40 of boom 14 (directly related to angle of boom 14 indicated by sensor 72) |
| WTB | = | weight of the section 20 itself (constant) |
| LTBP | = | distance to center of mass of section 20 from lower end of the section 20 inside boom 14 (directly related to the length of the boom 14 measured by transducer 74) |
| LTB | = | length of the section 20 between the pivot point platform 12 on end 40 and the lower end of section 20 inside boom 14 (directly related to the length of the boom 14 measured by transducer 74) |

Simultaneous Equations:

$$WTB \times LTBP + WB \times (LTB + XB) + WL \times (LTB + XL) - FF \times LF = 0$$

$$WL \times XL + WB \times XB - FH \times LH = 0$$

Actual Load Solution:

$$WL = \frac{FF \times LF - FH \times LH - WB \times LTB - WTB \times LTBP}{LTB}$$

The actual load analysis outlined above is performed in order to determine the actual weight of items placed upon the platform 12. The analysis is performed by solving a pair of simultaneous equations representing the moments about the opposite ends of the tip boom section 20. The approach taken to the solution of the actual load analysis (the figure WL) is used as a part of the analysis outlined above for the maximum allowable load.

The computer program listing included in the description of the preferred embodiment of this invention is a listing, in the source language, of the program steps used in the operation of the processor 108. The program is written for a Motorola Exorciser brand software development computer which is commercially available from Motorola Semiconductor Products, Inc. The particular language used in the listing is that corresponding to the RASMO5 assembler which is used in conjuction with the Exorciser brand computer. The assembler is utilized to produce the machine code for storage inside the read only memory of the processor 108. The program listing includes page headers listing the page numbers for each page of the listing, and further includes a series of columns showing the program steps. From left to right, the columns are a listing of line numbers, executable step numbers, an operations code, two columns for operands, a label, an operation code mnemonic, an operand mnemonic, and a comment. Comment lines are indicated in the listing by lines with an asterisk in the label column. Much of the comment materials included with the program have been deleted herein as being superfluous to this description and repetitious of the explanation of the flow charts in FIGS. 11 and 12 above.

What is claimed is:

1. An aerial work platform machine having a base, a load carrying work platform and a boom extending there between and connected to said base and said work platform;

sensors mounted on said aerial work platform machine, the output of said sensors changing as the weight and position of loads on said work platform change;

an electronic controller connected to said sensors, said electronic controller including means responsive to changes in the output of said sensors due to said changes in weight and position for determining when a preselected safe working moment for the aerial work platform machine has been met or exceeded by the actual moment.

2. The aerial work platform machine of claim 1 further comprising means electrically connected to said electronic controller for automatically preventing the machine from being subjected to a moment beyond a predetermined moment limit.

3. The aerial work platform of claim 1 wherein said electronic controller comprises a programmed digital computer having an analog to digital converter electrically connected to said sensors.

4. The aerial work platform machine of claim 1 wherein said platform is pivotally connected to said boom, said sensors include a main pressure transducer and the aerial work platform machine further comprises a slave leveling cylinder mounted between the boom and the work platform, said slave leveling cylinder hydraulically connected to said main pressure transducer.

5. The aerial work platform machine of claim 4 wherein said sensors further comprise an auxiliary pressure transducer for hydraulic connection to said slave leveling cylinder and for cooperating with said main pressure transducer to measure the difference in hydraulic pressure across said slave leveling cylinder.

6. The aerial work platform machine of claim 1 wherein said sensors comprise:

an angle sensor for attachment to said boom;

a boom length sensor;

means for determining the allowable weight in said measured location which may be safely carried by the work platform machine based on a predetermined allowable moment; and means for comparing said actual weight to said allowable weight.

7. The aerial work platform machine of claim 1 wherein said sensors include sensors for measuring two separate moments about two separate axes located along the length of the boom, said axes being located such that the moments sensed are capable of use in simultaneous equations for determining the weight and position of any actual load located on said work platform.

8. The aerial work platform machine of claim 7 wherein said determining means included in said electronic controller includes means for determining both the weight and the position of any load on said work platform.

9. The aerial work platform machine of claim 8 further comprising a display means electrically connected to said electronic controller for displaying the amount of weight detected by said sensors on said work platform.

10. The aerial work platform of claim 8 wherein said electronic controller further comprises means for allowing the calibration of the control system by displaying sequentially the actual load weight carried by the work platform, and the position of the work platform relative to the base.

11. An aerial work platform machine comprising:

a work platform;

a boom having two adjacent telescoping sections, said platform being supported by said boom;

a load cell sensor mounted within said boom, between said adjacent telescoping sections of said boom, said sensor measuring transverse forces between said sections;

a second sensor mounted between said boom and said work platform measuring the force needed to keep said work platform in position;

an electronic controller electrically coupled to said sensors, said controller including means for determining the weight supported by said work platform, using the forces measured by both said load cell sensor and said second sensor.

12. The aerial work platform machine of claim 11 wherein said boom further comprises:

a slide integral with one of said sections; and a slide pad, integral with the other of said sections, said slide and said slide pad juxtaposed to provide support and juxtaposed to provide a sliding contact between said sections, and said load cell sensor being mounted between said slide and said slide pad.

13. The aerial work platform machine of claim 11 comprising means for determining the position of any weight supported on said work platform using the forces measured by both said load cell sensor and said second sensor.

14. An aerial work platform machine having a boom extending between a base and a work platform;

means for determining the operating condition of said machine; and means, responsive to the position of weight on the work platform, for analyzing said operating condition to evaluate the safety of said machine.

15. An aerial work platform machine having a platform for carrying weight, comprising;

means for measuring the actual weight carried by the platform;

means for measuring the location of the actual weight on the platform;

monitoring the position of any load on the work platform to determine the forces tending to tip the aerial work platform machine; and determining whether said safe working limit has been met or exceeded by said forces.

16. The aerial work platform machine of claim 15 further comprising means for automatically controlling the operation of said machine so that said machine is prevented from being placed in a position beyond predetermined operation safety limits.

17. An aerial work platform machine having a base, a boom pivotally connected at one end to said base and a work platform pivotally connected to the other end of said boom;

means for determining the actual load weight and position of a load located on said work platform;

means for sensing the angular position and length of said boom with respect to said base and for determining a maximum allowable load weight for said sensed position and length of said boom and said determined position of said load based on a predetermined safe working moment about the pivot axis between said boom and said base, means for comparing the actual load weight with the allowable load weight.

18. The aerial work platform machine of claim 17 further comprising means for providing an indication that the actual load weight is near the allowable load weight.

19. The aerial work platform machine of claim 18 wherein said indication means includes a first indicator, providing a first warning when the actual load weight is approximately 85% of the allowable load weight and a second indicator providing a second warning when the actual load weight is 100% of the allowable load weight.

20. The aerial work platform machine of claim 18 further including means for preventing movement of the machine unless such movement would act to increase the allowable load weight when the actual load weight is approximately 105% of the allowable load.

21. A control method for assuring the safe operation of an aerial work platform machine having a platform for carrying weight, said method comprising the steps of:

determining the position of said platform in relation to the remainder of said work platform machine;

determining the actual amount of weight carried by said platform;

determining the position with respect to said platform of any weight carried by said platform;

determining the allowable amount of weight which may be safely carried by said machine when said platform is in the above determined position with respect to the remainder of said machine and the weight is located in the above determined position on said platform;

comparing said actual amount of weight to said allowable amount of weight; and providing a safety appraisal based on the results from said comparison.

22. A method for safely controlling the use of an aerial work platform machine having a base, an extendable boom mounted on said base, and a work platform mounted on said boom, said aerial work platform machine having forces acting thereon, tending to tip said aerial work platform machine, method comprising:

selecting a safe working limit for the forces tending to tip the particular aerial work platform machine being used;

a load cell transducer mounted inside said boom; and a pressure transducer for hydraulic connection to a slave leveling cylinder mounted between said work platform and said boom.

23. The method of claim 22 wherein said monitoring and determining steps includes:

determining the weight and position of an actual load on the work platform, said method further comprises:

determining the weight, hereinafter the "allowable load," which when placed at the position on the work platform of the actual load would result in forces equal to the safe working limit; an comparing the allowable load with the actual load weight.

* * * * *